United States Patent [19]

Hansel

[11] 3,996,975

[45] Dec. 14, 1976

[54] PRESSURE RELIEF SYSTEM

[75] Inventor: William B. Hansel, Media, Pa.

[73] Assignee: Sun Oil Company of Pennsylvania, Philadelphia, Pa.

[22] Filed: Oct. 16, 1975

[21] Appl. No.: 623,208

[52] U.S. Cl. ..... 141/45; 55/387

[51] Int. Cl.[2] ..... B65B 31/06

[58] Field of Search ..... 141/44, 45, 52, 53, 141/59, 290; 55/74, 387; 220/85 VR, 85 VS, 86 R; 62/54

[56] References Cited

UNITED STATES PATENTS 3,776,283 12/1973 Kramer et al. ..... 141/45

*Primary Examiner*—Houston S. Bell, Jr.
*Attorney, Agent, or Firm*—J. Edward Hess; Donald R. Johnson; Gary V. Pack

[57] ABSTRACT

A system for automatically releasing the pressure built up inside a tank when the liquid level falls below a predetermined level. This system is particularly applicable for use on a hydrocarbon tank truck which receives the vapors from the underground tank being filled, so that the pressure built up during filling can be released into the atmosphere through a filter in order to minimize the hydrocarbons released into the atmosphere when the connections to the underground tank are uncoupled. The system includes a pressure relief line connected to a float valve located inside a tank compartment on one end and to a filter on the other end. The filter can be made out of an adsorbant material which permits it to be cleaned and used over again.

15 Claims, 3 Drawing Figures

PRESSURE RELIEF SYSTEM

BACKGROUND OF THE INVENTION

This invention relates to pressure relief systems and more specifically to a pressure relief system for use on a hydrocarbon tank truck to minimize hydrocarbon pollution of the atmosphere caused by the pressure inside the tank.

Current government regulations require in some localities that underground hydrocarbon storage tanks for service stations have facilities for preventing the flow of hydrocarbon vapors into the atmosphere when these tanks are filled. One such system includes the use of a pipeline to carry the vapor from the underground tank back to the tank truck. One of the problems encountered in using this system is the variance in temperatures of the gasoline in the tank truck and the temperature of the gasoline and the vapor in the underground storage tank. These temperature variances can build up excess pressure inside the tank truck or inside the underground storage tank during filling. Additional vapors are generated by the turbulence created during filling. When the hose connections to the tanks are broken after the underground storage tank is filled, the vapor pressure inside these tanks can often cause hydrocarbon vapors to be forced into the atmosphere.

SUMMARY OF THE INVENTION

In accordance with a preferred embodiment, a pressure relief system is provided which automatically releases the pressure in a tank through a vapor collection device when the filling process is essentially completed, so that when the connections to the tank are broken, the amount of vapors released into the atmosphere is minimized. One embodiment of the pressure relief system includes a pressure relief line connected to the vapor collection device and extending into each tank compartment on a hydrocarbon tank truck and down to a liquid level sensitive valve located near the bottom of each compartment. The vapor collection device can be a filter which traps the vapors in the exhausted air so that when the liquid level in a tank compartment falls below the valve, the pressure built up inside is released into the atmosphere through the filter.

While this pressure relief system is particularly adapted for use on a hydrocarbon tank truck; it is evident that such a system may have applications in other environments where pressure must be automatically released into the atmosphere without polluting the air.

The pressure relief system provides a reliable and virtually maintenance free environmental system which supplements the vapor recovery systems now in use. It also serves to make an empty tank truck safer by permitting it to breath.

The use of adsorbant material in the filter adds another advantage to the pressure relief system by permitting the filter to be cleaned by desorbing the vapors when the tank truck is being filled, so that the filter can be reused.

A better understanding of the invention and its advantages can be seen in the following description of the Figures and the preferred embodiments.

DESCRIPTION OF THE DRAWINGS AND PREFERRED EMBODIMENT

Figure 1:
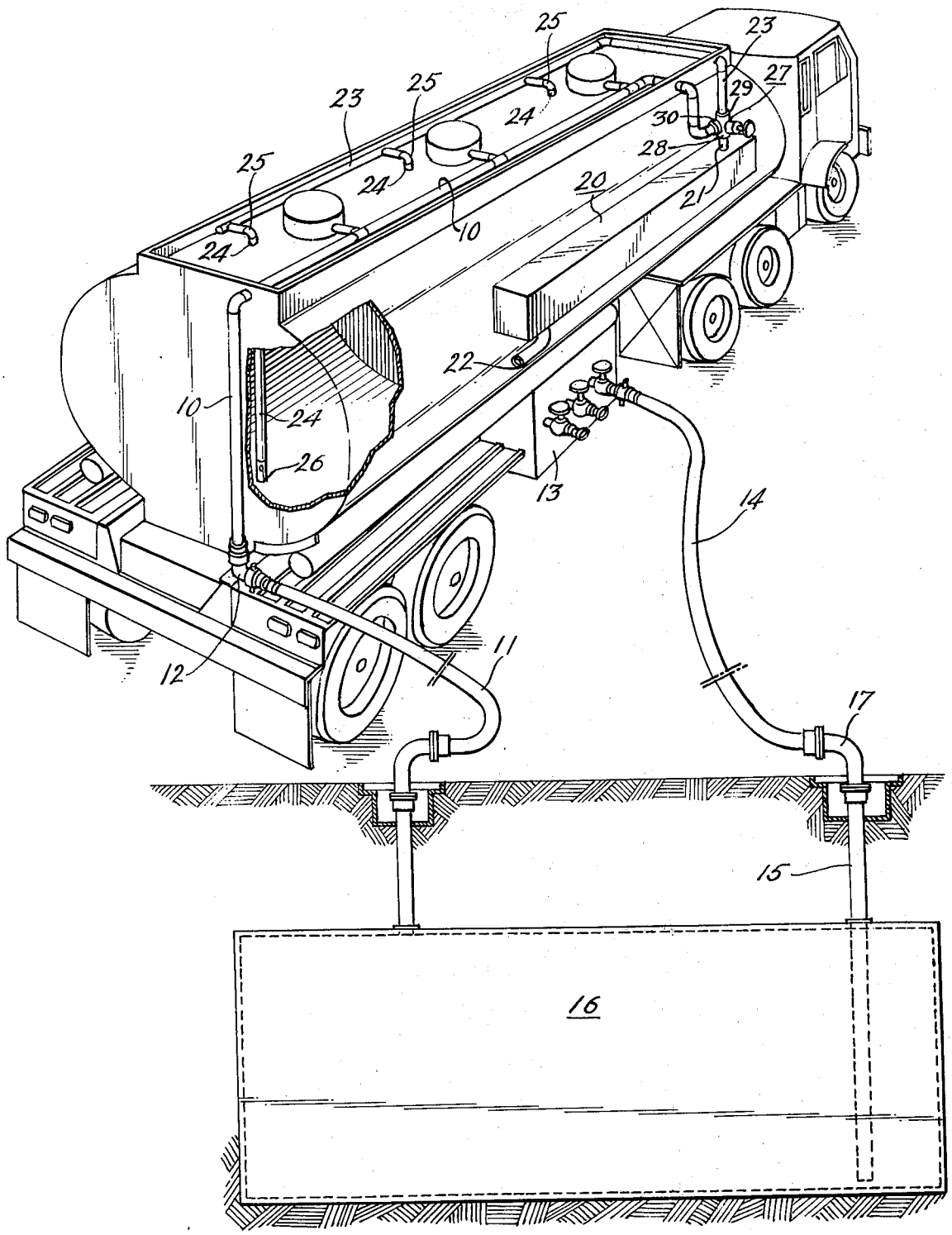
FIG. 1 is an illustration of a typical tank truck having a pressure relief system in accordance with this invention, which is connected for filling an underground storage tank and for receiving the vapors generated therefrom.

The pressure relief system described herein can possibly be used on many tank systems, therefore, the illustrated embodiment is used as an example of one complete tank filling system with the pressure relief system.

In the Figures, a standard tank truck equipped to receive the vapors displaced from an underground storage tank and having three individual compartments is illustrated. The tank truck has a vapor recovery line 10 which is connected to the upper portion of each compartment of the tank truck and to vapor recovery hose 11 through a swivel fitting 12. The bottom of each tank compartment is connected to a dispensing control panel 13 (by means not shown). Dispensing hose 14 is connected to dispensing panel 13 on one end and is connected to fillpipe 15 of underground tank 16 through dry break connection 17. When filling underground tank 16, the gasoline flows from each compartment through dispensing panel 13, dispensing hose 14, and into the tank 16 through fillpipe 15. The vapors in tank 16 flow back into the compartments of the tank truck through the vapor recovery hose 11 and the vapor recovery line 10.

A vapor collection device, such as filter 20, is mounted on the side of the tank truck, and has an intake 21 and an exhaust 22. The filter is preferably of the type which can adsorb the vapors so that they can easily be removed to permit reuse of the filter, such as charcoal. Intake 21 is connected to a liquid level sensitive valving system located in each tank compartment through pressure relief line 23. Each valving system includes a vertical line 24 which extends from the bottom of each compartment through the top of the compartment, where it is connected to pressure relief line 23 through elbow fittings 25. At the end of each vertical line 24, which is located at the bottom of each compartment, a float valve 26 is installed. Near the point where pressure relief line 23 connects intake 21 of filter 20, a three-way diverting valve 27 is placed. Ports 28, 29 and 30 are connected to intake 21, relief line 23, and vapor return line 10, respectfully, so that when valve 27 is in first position, flow between intake 21 and pressure relief line 23 is permitted and in a second position, flow between intake 21 and vapor return line 10 is permitted.

When the tank truck is filled with gasoline, valve 27 is placed in the first position and float valve 26 remains closed, thereby preventing the exit of any vapors. During filling of underground tank 16, the vapors flow back into each compartment through vapor return hose 11 and vapor return line 10. Each float valve 26 opens once the liquid level in its respective tank compartment falls below the level of the float, thereby releasing any excess pressure into the atmosphere through filter 20.

Figure 2:
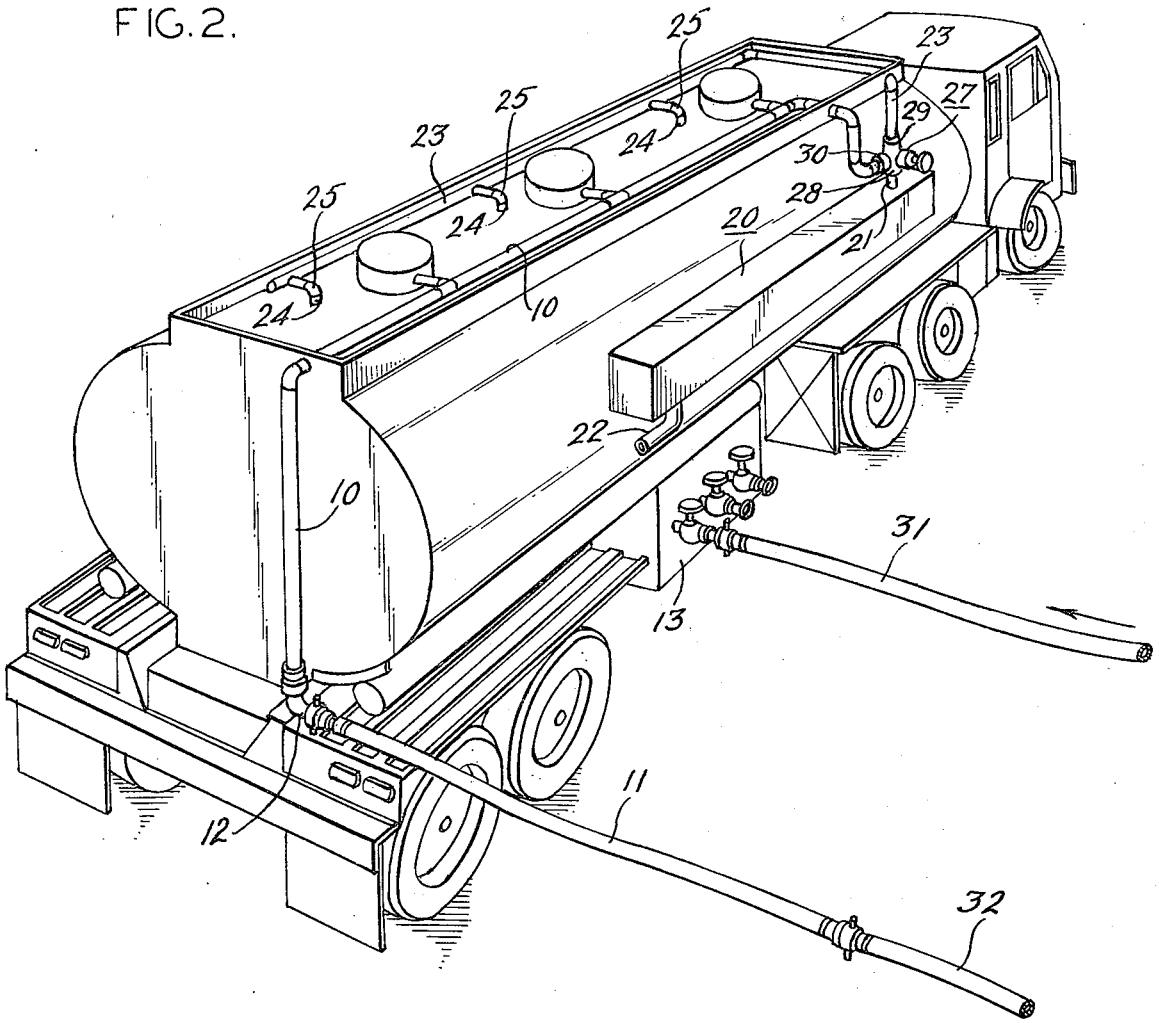
FIG. 2 is an illustration of the tank truck in FIG. 1 connected for filling the tank truck at a terminal and for desorbing the vapors trapped in the filter.

FIG. 2 illustrates the tank truck connected to be filled at a terminal. The tank truck is connected for bottom filling through hose 31 and vapor return hose 11 is connected to hose 32 for collection of the vapors which are inside the tank truck. During the time when the tank truck is being filled, filter 20 can be desorbed of the hydrocarbon vapors which have been trapped therein. This is accomplished by moving valve 27 into the second position so that intake 21 of filter 20 is connected to vapor return line 10. As each compartment in the tank truck is being filled, the vapors are displaced out through vapor return line 10 to a facility at the terminal for condensing the vapors back into a liquid (not shown). The flow of vapors in vapor return line 10 creates a vacuum which pulls fresh air back through filter 20, in through exhaust 22 and out through intake 21, through ports 28 and 30 of valve 27, and into vapor return line 10. This flow of fresh air acts to clean filter 20 by removing the hydrocarbon vapors trapped therein.

Figure 3:
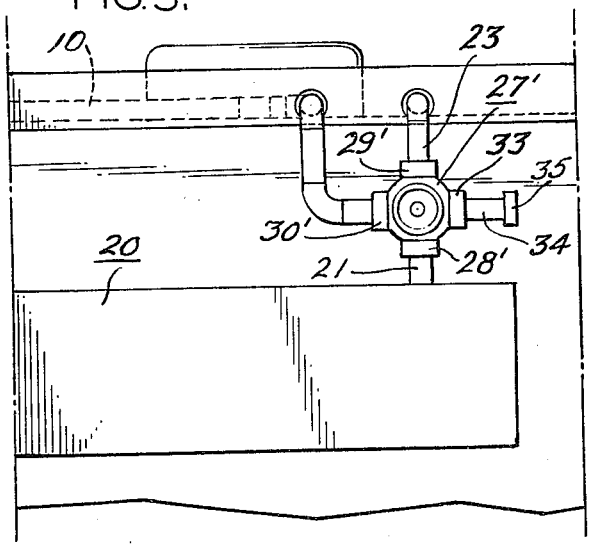
FIG. 3 is an illustration of an alternative embodiment for connection of the filter to the tank truck.

A second arrangement for connecting filter 20 is illustrated in FIG. 3. This system is designed to permit the use of an auxilary vacuum pump system to clean filter 20 instead of vapor return line 10. This system requires a four-way valve 27′ to be used in place of three-way valve 27. A coupling 34 with a cap 35 for connection to the vacuum pump system (not shown) is connected to port 33 of valve 27′. Four-way valve 27′ is designed to have the aforementioned positions of three-way valve 27 as well as a third position which connects port 28′ to port 33.

While a particular embodiment of this invention has been shown and described it is obvious that changes and modifications can be made without departing from the true spirit and scope of the invention. It is the intention of the appended claims to cover all such changes and modifications.

The invention claimed is:

1. In a system for filling a receiving tank with a vaporous liquid from a source tank in which the filling system includes a dispensing line connected between the source tank and the receiving tank for directing the liquid to flow from the source tank to the receiving tank, and a vapor recovery system having a vapor recovery line connected between the receiving tank and the source tank for directing the vapors displaced from the receiving tank during the filling process to the source tank, and in which a pressure different than atmospheric pressure can develop in the filling system during the filling process due to the different ambient temperatures in the tanks as well as other conditions in the filling system, thereby possibly causing additional vapors from the filling system to be forced into the atmosphere when the connections to the tanks are uncoupled at the end of the filling operation in the event the pressure in the filling system is above atmospheric pressure;

an improvement for equalizing the pressure in the filling system at the end, or nearly at the end of the filling process, so that when the connections to the tanks are uncoupled, the amount of vapors forced into the atmosphere by the pressure in the filling system above atmospheric pressure is minimized, said improvement comprising:

a. a vapor collection means having an inlet and designed to collect the vapors forced into it by the pressure inside the filling system which is above atmospheric pressure, and to permit the filling system pressure to become equal to atmospheric pressure;

b. means for providing fluid communication between the inlet of the vapor collection means and the vapors in the filling system;

c. valving means; and d. means for connecting the valving means to the fluid communication means so that when the valving means is in its closed position, fluid flow through the fluid communication means from the vapors in the filling system to the vapor collection means is prevented to permit efficient recovery of the vapors in the source tank during the filling process, and so that when the valving means is in its open position, fluid flow through the fluid communication means is permitted to allow the pressure in the filling system to become equal to atmospheric pressure, as well as to enable the vapor collection means to collect vapors, in the event the pressure in the filling system is above atmospheric pressure, to prevent pollution of the atmosphere by the vapors when the lines connecting the tanks are disconnected.

2. System recited in claim 1 wherein the vapor collection means comprises a filter having an outlet to the atmosphere.

3. System recited in claim 2, wherein the filter is made of material which adsorbs the vapors.

4. System recited in claim 3, wherein the adsorbing material in the filter is charcoal.

5. System recited in claim 3, wherein the filter is in fluid communication with the vapors in the source tank, and further comprises means for reversing the flow of fluid through the filter by connecting the inlet of the filter to a vacuum source so that the filter can be cleaned by having clean air flow in the outlet and exit the inlet of the filter.

6. System recited in claim 5, wherein the vacuum source is the vapor recovery line, which acts as a vacuum on the filter due to the flow of vapors out of the source tank through the vapor recovery line when the source tank is filled.

7. System recited in claim 1, wherein valving means comprises a liquid level sensitive valve.

8. System recited in claim 1, wherein the valving means comprises a float valve connected to the fluid communication means at a point near the bottom of the source tank.

9. System recited in claim 2, wherein valving means comprises a liquid level sensitive valve.

10. System recited in claim 2, wherein the valving means comprises a float valve connected to the fluid communication means at a point near the bottom of the source tank.

11. In a supply tank on a truck for carrying hydrocarbons and equipped to deliver the hydrocarbons to a receiving tank, wherein the supply tank and the receiving tank are connected by a dispensing line for directing the flow of hydrocarbon liquid from the supply tank to the receiving tank, and by a vapor recovery line for displacing the hydrocarbon vapors in the receiving tank into the supply tank during the filling process, and in which a pressure different than atmospheric pressure can develop in the tanks during the filling process due to the different ambient temperatures in the tanks as well as other conditions in the tanks, thereby possibly causing additional vapors from the tanks to be forced into the atmosphere when the connections to the tanks are uncoupled at the end of the filling operation, in the event the pressure in the tanks is above atmospheric pressure;

an improvement for relieving the pressure in the supply tank and the receiving tank at the end, or nearly at the end of the filling process, so that when the connections to the tanks are uncoupled, the amount of vapors forced into the atmosphere by the pressure in the tank truck and the receiving tank being above atmospheric pressure is minimized, said improvement comprising:

a. a filter having an outlet open to the atmosphere and an inlet, and designed to collect the hydrocarbon vapors forced into it by the pressure inside the tank truck which is above atmospheric pressure;

b. means for providing fluid communication between the inlet of the filter and the inside of the supply tank;

c. valving means; and d. means for connecting the valving means to the fluid communication means so that when the valving means is in its closed position, fluid flow through the fluid communication means from the vapors in the supply tank to the filter is prevented to permit efficient recovery of the vapors in the supply tank during the filling process, and so that when the valving means is in its open position, fluid flow through the fluid communication means is permitted to allow the pressure in the tanks to become equal to atmospheric pressure, as well as to enable the filter to collect vapors, in the event the pressure in the tanks is above atmospheric pressure, to prevent pollution of the atmosphere by the hydrocarbon vapors when the lines connecting the tanks are disconnected.

12. System recited in claim 11 wherein the filter is constructed of material which adsorbs the hydrocarbon vapors.

13. System recited in claim 11, wherein the valving means comprises a float valve connected to the fluid communication means at a point near the bottom of the tank truck.

14. System recited in claim 11, wherein the filter is in fluid communication with the vapors in the tank truck, and further comprises means for reversing the flow of fluid through the filter by connecting the inlet of the filter to a vacuum source so that the filter can be cleaned by having clean air flow in the outlet and exit the inlet of the filter.

15. System recited in claim 13, wherein the fluid communication means comprises a length of tubing extending from the inlet of the filter, down through the upper portion of the supply tank, terminating inside the supply tank, near the bottom.

* * * * *